US007878859B2

(12) United States Patent
Zhu

(10) Patent No.: US 7,878,859 B2
(45) Date of Patent: Feb. 1, 2011

(54) ELECTRICAL CONNECTOR ASSEMBLY WITH A TRANSITION BOARD

(75) Inventor: Yu Zhu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/471,420

(22) Filed: May 25, 2009

(65) Prior Publication Data

US 2010/0003857 A1 Jan. 7, 2010

(51) Int. Cl.
*H01R 13/60* (2006.01)

(52) U.S. Cl. ..... 439/638; 439/76.1

(58) Field of Classification Search ..... 439/76.1, 439/638

See application file for complete search history.

(56) References Cited

U.S. PATENT DOCUMENTS 4,618,196 A 10/1986 Muzslay
6,891,735 B2 5/2005 Hultermans et al.
2004/0072473 A1 * 4/2004 Wu ..... 439/638

FOREIGN PATENT DOCUMENTS

TW 545736 TW 8/2003

* cited by examiner

*Primary Examiner*—Ross N Gushi
(74) *Attorney, Agent, or Firm*—Wei Te Chung; Andrew C. Cheng; Ming Chieh Chang

(57) ABSTRACT

An electrical connector assembly includes a first and a second connector (1, 2) each including an insulating housing and a plurality of terminals retained in the housing. The housing has a front mating portion, a rear face and a pair of first retaining portions at opposite ends of the rear face of the insulating housing. The terminals include leg portions extending out of the rear face of the housing. A receiving cavity (15) is defined between the pair of retaining portions of the first connector. A transition board (3) is vertically received in the receiving cavity of the first connector and the two pairs of retaining portions are engaged with each other to assembly the two connectors together.

17 Claims, 5 Drawing Sheets

ELECTRICAL CONNECTOR ASSEMBLY WITH A TRANSITION BOARD

BACKGROUND OF THE INVENTION

1. Field of the Invention

The present invention relates to an electrical connector assembly with a transition board.

2. Description of the Related Art

Taiwan patent issue number 545736 discloses a connector assembly with two mating sub-connectors unitarily stacked from top to bottom to mate with two plug connectors. A slot is provided between the two sub-connectors to be inserted by a printed circuit board. A plurality of terminals are retained in the sub-connectors and have resilient pressing legs extending beyond the rear face of the connector assembly to abut against conductive pads on the printed circuit board.

In other printed circuit boards with different conductive pads, different stacked type of the sub-connectors are needed to meet the conductive pads of the printed circuit board.

BRIEF SUMMARY OF THE INVENTION

It is an object of the present invention to provide an electrical connector assembly which is assembled facility.

In order to achieve the objective above, an electrical connector assembly comprises a first and a second connector each comprising an insulating housing and a plurality of terminals retained in the housing. The housing has a front mating portion, a rear face and a pair of first retaining portions at opposite ends of the rear face of the insulating housing. The terminals comprise leg portions extending out of the rear face of the housing. A receiving cavity is defined between the pair of the retaining portions of the first connector. A transition board is vertically received in the receiving cavity and the two pair of retaining portions are engaged with each other to assembly the two connectors together.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

Figure 1:
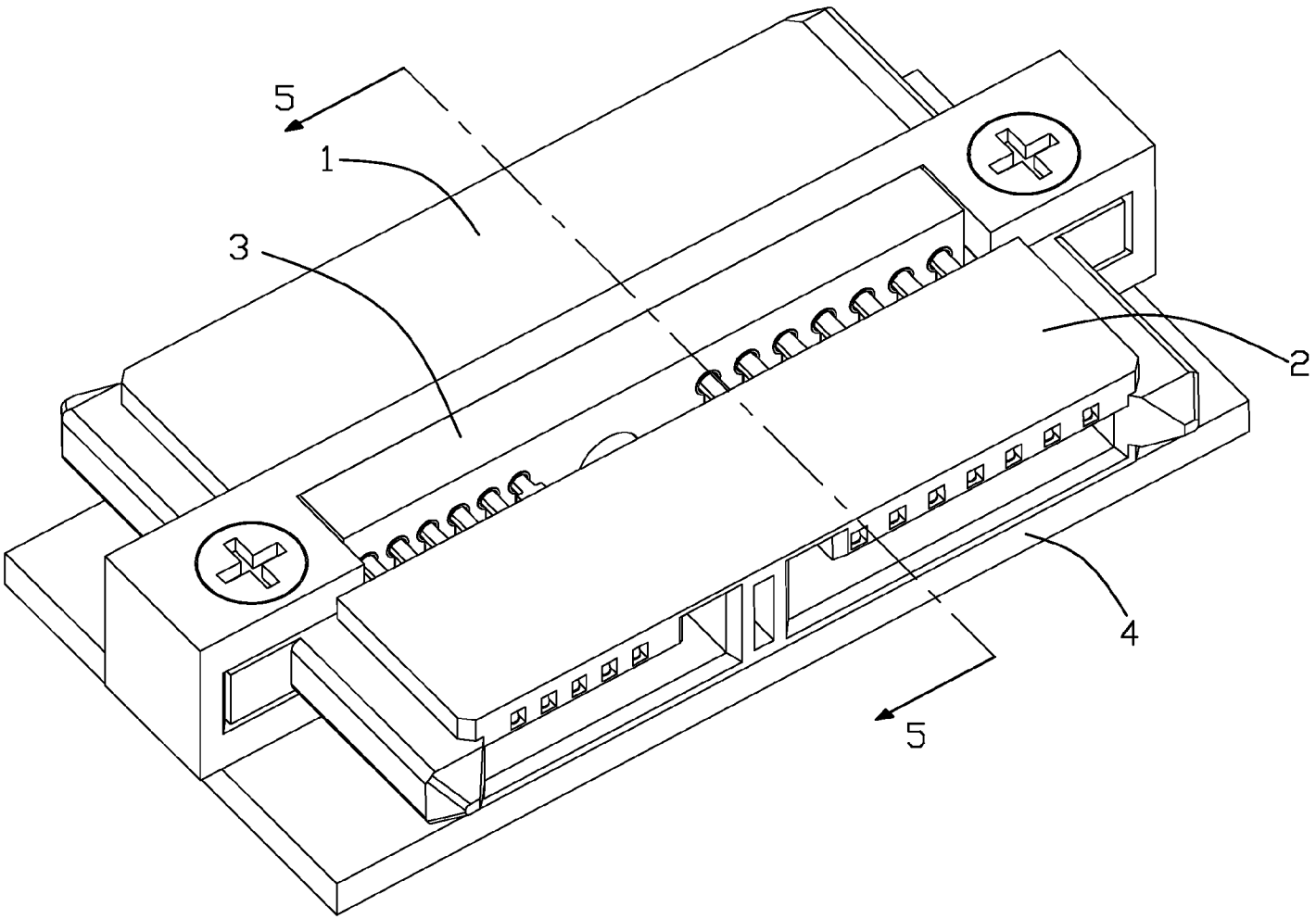
FIG. 1 is a perspective view of an electrical connector assembly according to the embodiment of the present invention, which is assembled on an immoveable board.

Please refer to FIG. 1, an electrical connector assembly according to the embodiment of present invention includes a first connector 1, a second connector 2 and a transition board 3 such as a daughter board. A plurality of terminals of the first and second connectors electrically connects to the transition board 3 to complete electrical connection between the two connectors. The two connectors are assembled on an immovable board 4 or a mother board (not shown).

Figure 2:
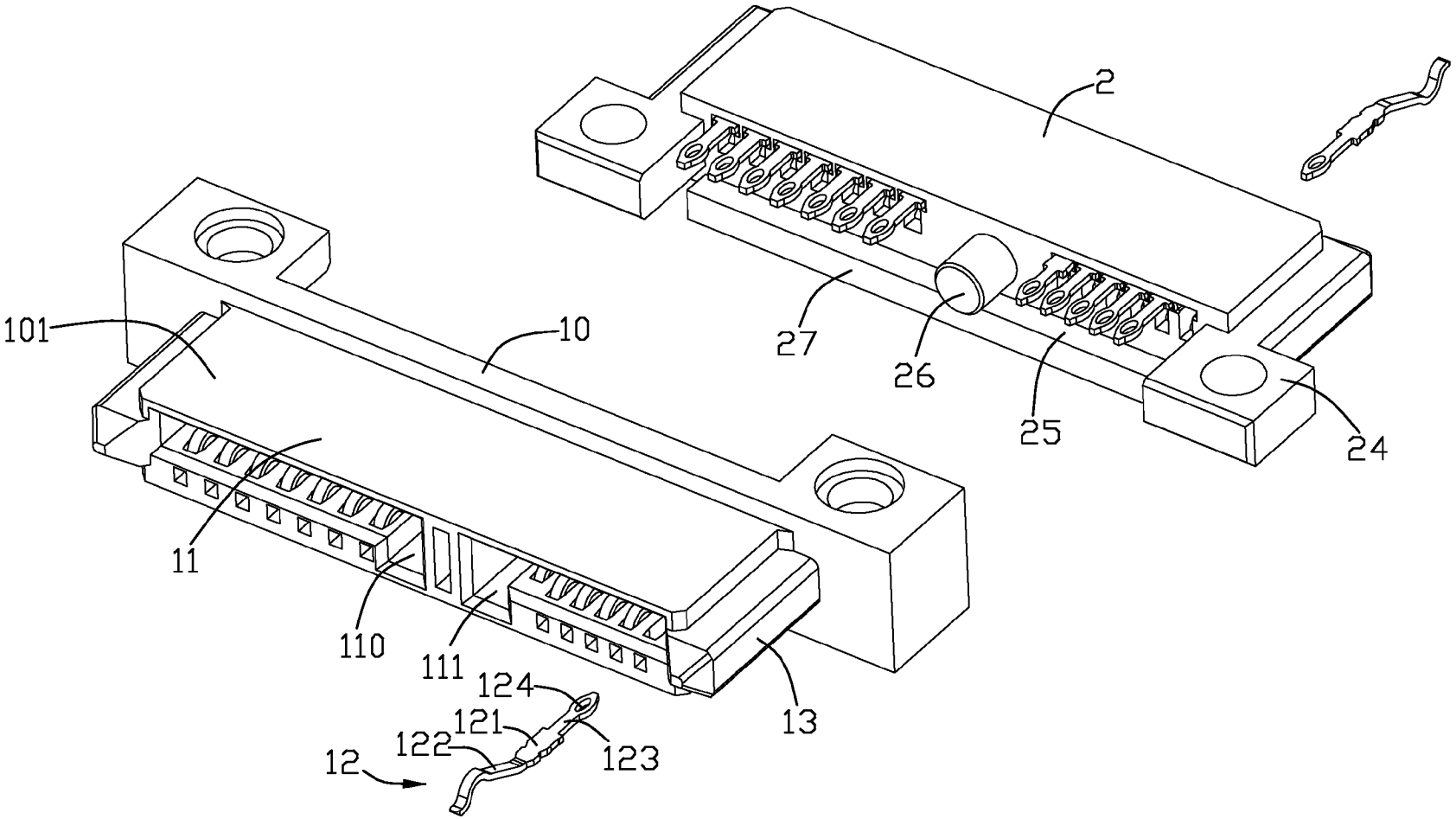
FIG. 2 is a partly exploded perspective view of the electrical connector assembly.
Figure 3:
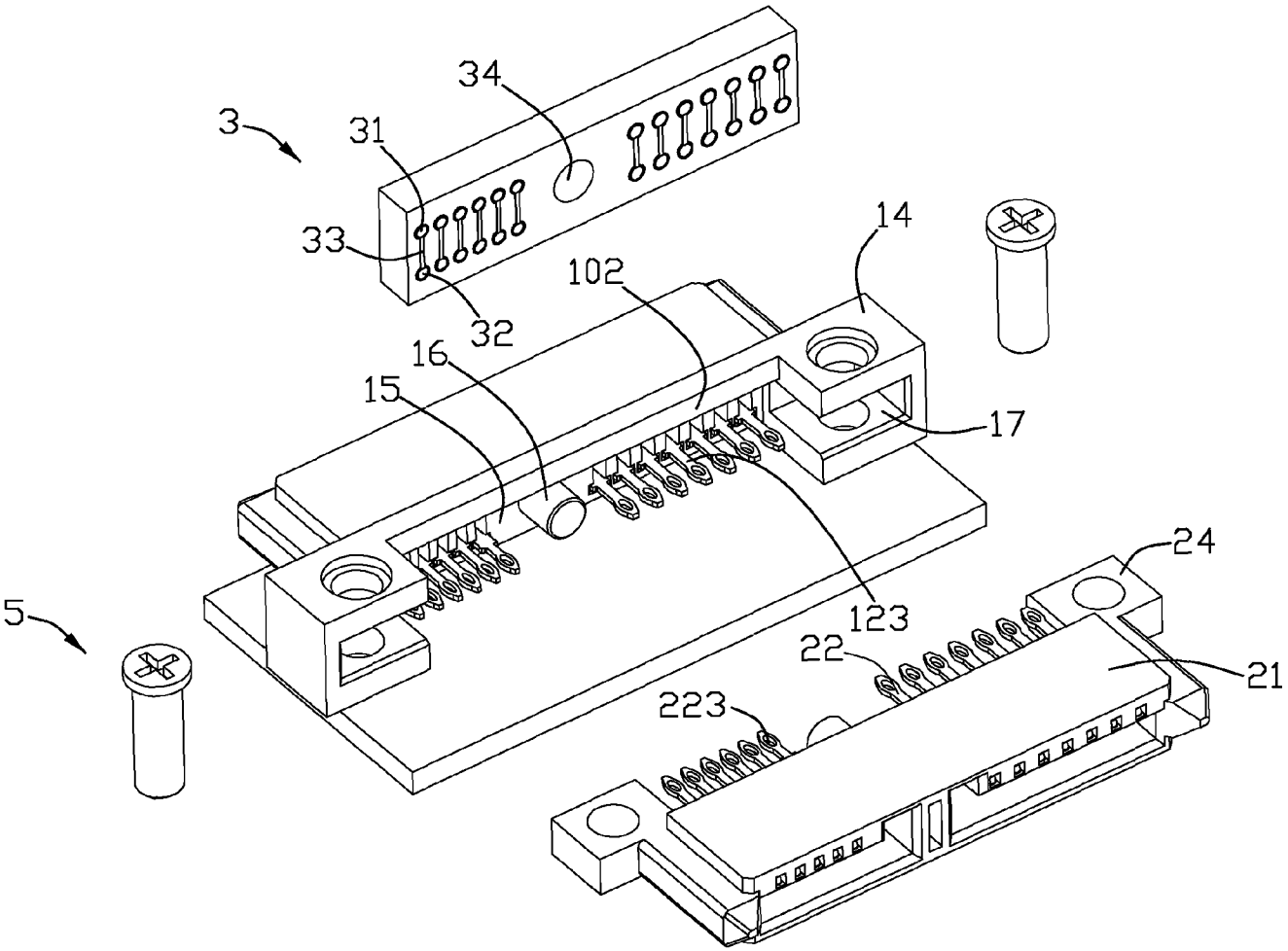
FIG. 3 is an exploded view of the electrical connector assembly shown in FIG. 1.
Figure 4:
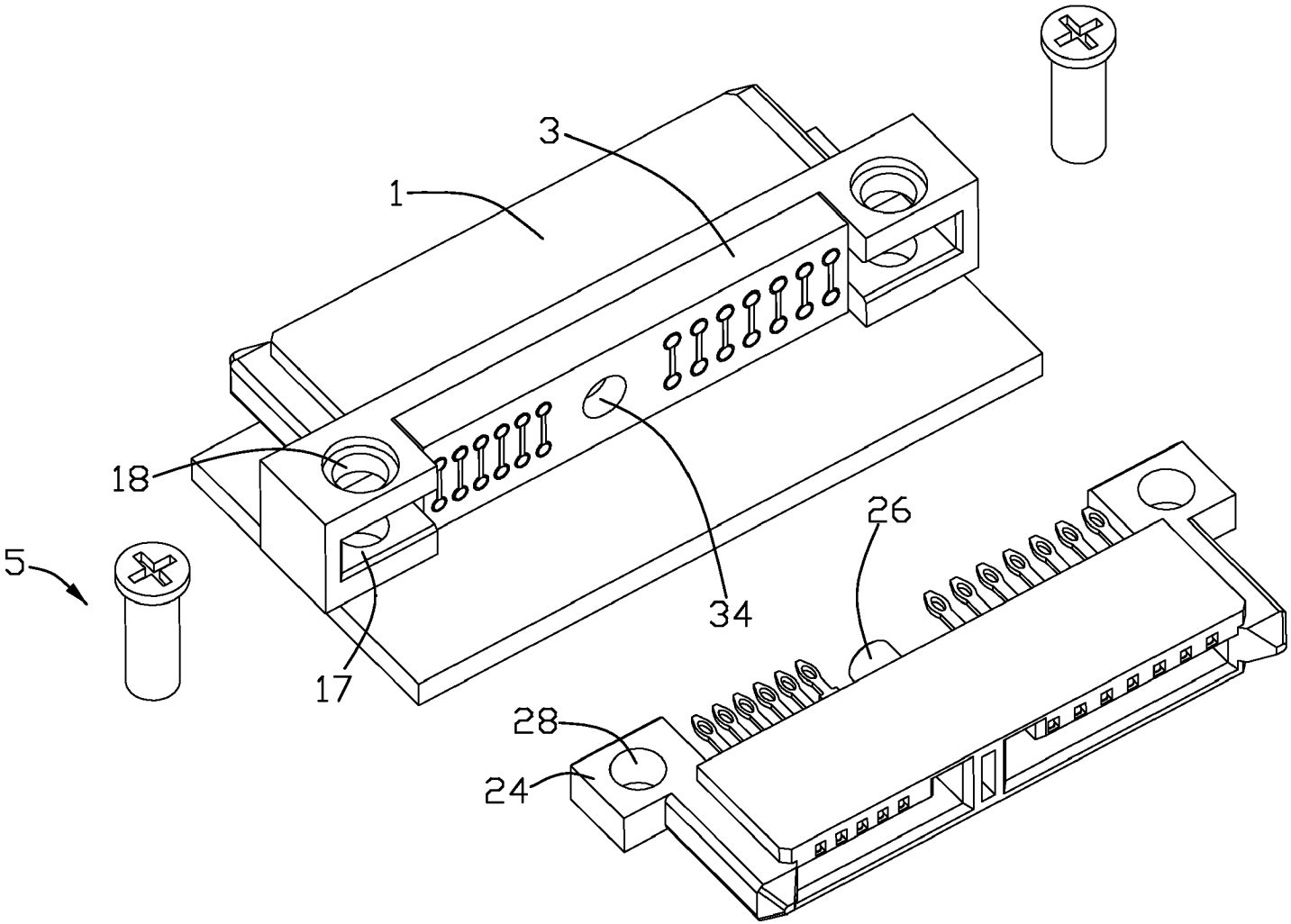
FIG. 4 is an exploded perspective view of the electrical connector assembly shown in FIG. 1.

Refer to FIGS. 2 and 3, front mating portions of the two connectors 1, 2 are similar and difference between the two connectors exists in rear end of the two connectors. The first connector 1 includes a longitudinal insulating housing 101 with a base 10 and a mating portion 11 extending forwards from the base 10. The mating portion 11 is divided with two L-shaped mating slot 110, 111 via a partition wall (not labeled). Combination with FIG. 5, the plurality of terminals 12 of the first connector 1 each include a retaining portion 121 with barbs retained in the base 10, a resilient contacting portion 122 extending forward from the retaining portion 121 into the mating slots 110, 111 and a leg portion 123 extending out a rear face of the base. The contacting portions 122 are pre-pressed in bosses 115 in the front of the mating portion 11. The leg portions 123 are enlarged in dimension at distal ends thereof and each have a hole 124 at the enlarged distal ends. The mating portion 11 has a pair of guiding posts 13 at opposite ends thereof extending beyond a front mating face of the housing. The base 10 has a pair of first retaining portions 14 at opposite ends of a rear face 101 thereof and the first retaining portions 14 define grooves 17 opening rearwards and inwards to face to each. The first retaining portions 14 of the first connector 1 equal to the base 10 in height and are adjacent at two ends of the mating portion 11. A positioning post 16 extends rearward at a middle position at the rear face 102 of the base. A receiving cavity 15 is provided between the two first retaining portions 14 and the leg portions 123 of the terminals are in the receiving cavity 15.

The second connector 2 similar to the first connector 1, includes a mating portion 21 with mating slot and a plurality of terminals 22 with leg portions 223. The mating portion has a pair of second retaining portions 24 at opposite ends of a rear face thereof and the leg portion 223 are lined between the second retaining portions 24. A positioning post 26 extends rearward at a middle position at the rear face of the mating portion 21.

Figure 5:
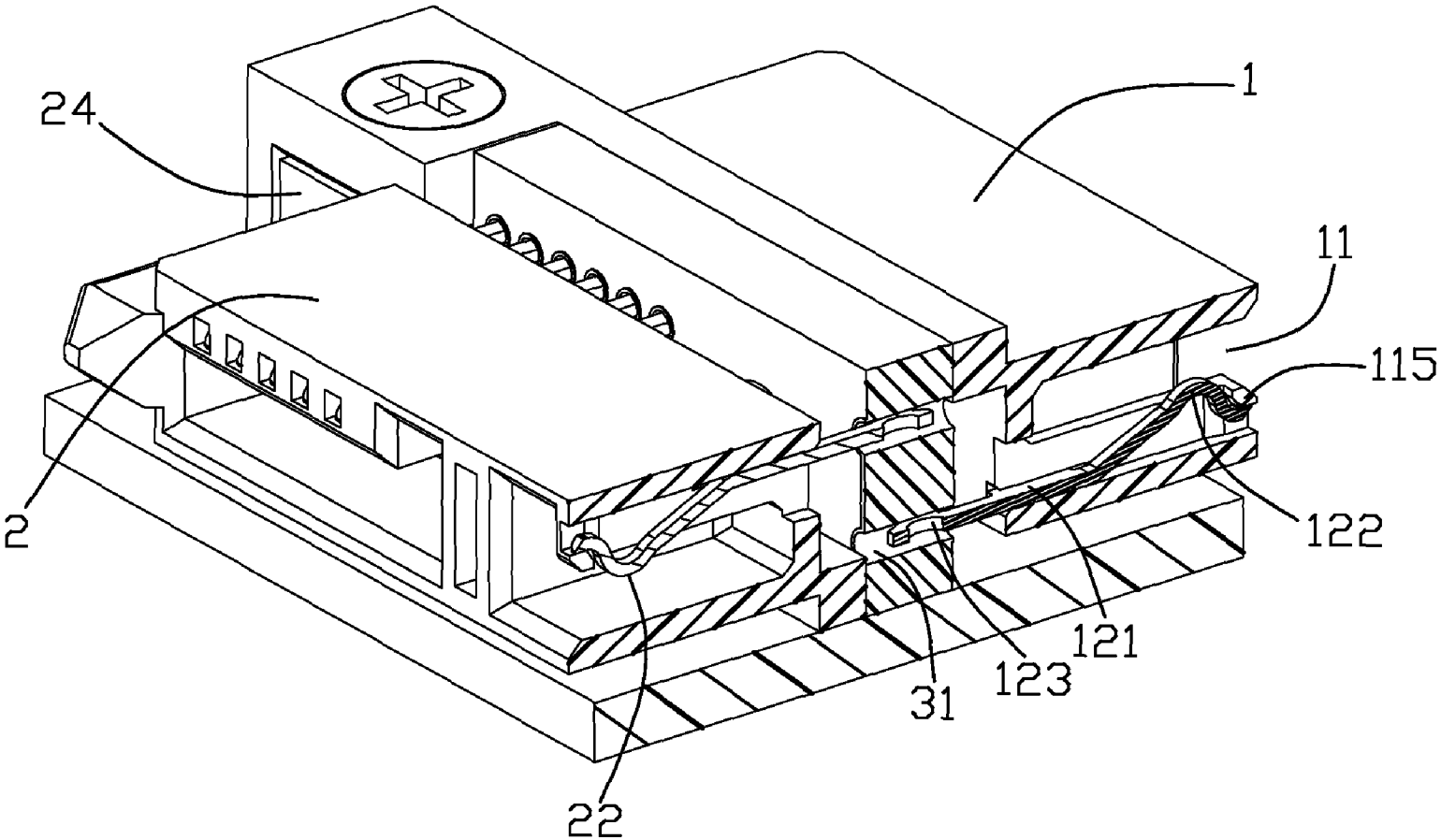
FIG. 5 is a cutaway perspective view of the electrical connector assembly taken along line 5-5 shown in FIG. 1.

The transition board 3 in upright gesture has two rows of upper and lower through holes 31, 32 through two opposite face and conductive traces 32 connecting with every upper and lower through holes. The two rows are divided into two groups by a positioning hole 34. The transition board 3 are vertically received in the receiving cavity 15 of the first connector 1, the positioning post 16 are received in the positioning hole 34 and the leg portions 123 are inserted in the lower through holes 32. The second retaining portions 24 of the second connector 2 are inserted into the grooves 17 of the first retaining portions 14, the positioning post 26 are receiving in the position hole 34 and the leg portions 223 are inserted into the upper through holes 31. Screw nut 5 pass screw holes 18, 28 defined in the retaining portions 14, 24 along a vertical direction to retain the connectors on the immovable board 4. The second retaining portions equal to the groove in a vertical direction The enlarged ends of the leg portions 123, 223 with holes are slight larger than the through holes 31, 32 of the transition board 3 so that the leg portions are retained in the through holes with pressing type, not soldering type, to decrease occurring area of the transition board 3. The two connectors are arranged back to back along a mating direction thereof and the transition board 3 hind in the receiving cavity 15, i.e. the transition board 4 does not beyond the first retaining portions 14 in the mating direction, thereby avoiding the second connector 2 touch the transition board 3 while assembling of the second connector. Referring to FIG. 5, a longitudinal rib 27 is defined at a rear face of the mating portion 21 of the second connector 2 to stand off the second connector 2. It is noted that the features of the invention include the first long and short mating ports or slots 110, 111 are essentially mirror images relative to the second long and short mating ports or slots in a vertical direction perpendicular to the front-to-back direction, the tail sections of the first contacts and those of the second contacts are respectively located at different levels relative to the printed circuit board in the vertical direction, and the first partition wall and the second partition wall are essentially aligned with each other in the front-to-back direction while being separated from each other by the printed circuit board 3.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a first connector comprising:

an insulating housing comprising a front mating portion, a rear face and a pair of first retaining portions at opposite ends of the rear face of the insulating housing, a receiving cavity being defined between the pair of first retaining portions;

a plurality of terminals retained in the insulating housing and comprising leg portions extending out of the rear face of the housing;

a second connector comprising:

an insulating housing comprising a front mating portion, a rear face and a pair of second retaining portions at opposite ends of the rear face of the insulating housing;

a plurality of terminals retained in the insulating housing and comprising leg portions extending out of the rear face of the insulating housing;

a transition board vertically received in the receiving cavity of the first connector;

the second retaining portions of the second connector being engaged with the first retaining portions of the first connector to assembly the two connector together;

wherein the first and second retaining portion have screw holes in a vertical direction.

2. The electrical connector assembly as recited in claim 1, wherein the first retaining portions each define a groove opening rearwards and the second retaining portions are inserted in grooves.

3. The electrical connector assembly as recited in claim 2, wherein the grooves opening inwards to communicate with the receiving cavity.

4. The electrical connector assembly as recited in claim 1, wherein the second connector defines a longitudinal rib at the rear face thereof.

5. The electrical connector assembly as recited in claim 1, wherein the leg portions of the terminals of the first and second connectors each have an enlarged end with a hole therein and the leg portions are inserted in and pressed against corresponding through holes defined on the transition board along.

6. The electrical connector assembly as recited in claim 5, wherein the transition board comprising an upper and a lower row of said through holes, the leg portions of the first connector are in the lower row of the through holes while the leg portions of the second connector are in the upper row of the through hole.

7. The electrical connector assembly as recited in claim 6, wherein the insulating housing of the first connector comprising a base portion, said front mating portion extends from the base portion, and the first retaining portions extend rearwards from the base portion while the second retaining portions extend from the front mating portion of the second connector.

8. The electrical connector assembly as recited in claim 7, wherein the second retaining portions equal to the groove in a vertical direction.

9. An electrical connector assembly comprising:

a first connector comprising:

an insulating housing comprising a front mating portion, a rear face and a pair of first retaining portions at opposite ends of the rear face of the insulating housing, a receiving cavity being defined between the pair of first retaining portions;

a plurality of terminals retained in the insulating housing and comprising leg portions extending out of the rear face of the housing;

a second connector comprising:

an insulating housing comprising a front mating portion, a rear face and a pair of second retaining portions at opposite ends of the rear face of the insulating housing;

a plurality of terminals retained in the insulating housing and comprising leg portions extending out of the rear face of the insulating housing;

a transition board vertically received in the receiving cavity of the first connector;

the second retaining portions of the second connector being engaged with the first retaining portions of the first connector to assembly the two connector together;

wherein the transition board has a positioning hole and the first and second connector each has a positioning post inserted into the positioning hole in opposite directions.

10. An electrical connector assembly comprising:

an first insulative housing defining thereof juxtaposed first horizontal long and short mating ports facing toward an exterior in a first direction and therein a plurality of first passageways extending along said first direction and communicating with said first long mating port and said first short mating port, respectively;

a first partition wall located between said first long mating port and said first short mating port;

a plurality of first contacts disposed in the correspond passageways, respectively;

an second insulative housing back to back assembled with regard to the first housing and defining thereof juxtaposed second horizontal long and short mating ports facing toward said exterior in a second direction opposite to said first direction, and therein a plurality of second passageways extending along said front-to-back direction;

a second partition wall located between said second long mating port and said second short mating port;

a plurality of second contacts disposed in the corresponding passageways, respectively;

a printed circuit board sandwiched between said first housing and said second housing in one of said first direction and second direction, and mechanically and electrically connected to tail sections of the corresponding first and second contacts, respectively; wherein said first long and short mating ports are essentially mirror images relative to the second long and short mating ports in a vertical direction perpendicular to said first direction and said second direction, said the tail sections of the first contacts and those of said second contacts are respectively located at different levels relative to the printed circuit board in said vertical direction, and said first partition wall and said second partition wall are essentially aligned with each other in said first direction.

11. The electrical connector assembly as claimed in claim 10, wherein said first partition wall and said second partition wall are respectfully equipped with corresponding mounting posts received in corresponding first and second holes in the printed circuit board.

12. The electrical connector assembly as claimed in claim 11, wherein said first and second holes are aligned and joined with each other in the first direction.

13. The electrical connector assembly as claimed in claim 10, wherein the first housing includes a first longitudinal rib located by one side of the corresponding tail sections of the first contacts in the vertical direction, and said second housing includes a second longitudinal rib located by one side of the corresponding tail sections of the second contacts in the vertical direction under condition that said first longitudinal rib and said second longitudinal rib are located at two different levels and respectfully abut against opposite surfaces of the printed circuit board.

14. The electrical connector assembly as claimed in claim 13, wherein the tail sections of the first contacts and the first longitudinal rib are respectively located by one two sides of the printed circuit board in the vertical direction, and the tail sections of the second contacts of the second longitudinal rib are respectively located by said two sides of the printed circuit board in the vertical direction in a reversed manner.

15. The electrical connector assembly as claimed in claim 10, wherein the first housing includes a pair of first retention portions located at two opposite lateral ends, and the second housing includes a pair of second retention portions located at two opposite lateral ends and being offset from awhile overlapped with said first retention portions, respectively, in the vertical direction.

16. The electrical connector assembly as claimed in claim 15, wherein a pair of fastening devices extend through both corresponding first retention portion and second retention portion.

17. The electrical connector assembly as claimed in claim 16, wherein said first retention portion receives the corresponding second retention portion.

* * * * *